US007833955B2

(12) United States Patent
Burrington et al.

(10) Patent No.: US 7,833,955 B2
(45) **Date of Patent: *Nov. 16, 2010**

(54) VISCOSITY MODIFIERS IN CONTROLLED RELEASE LUBRICANT ADDITIVE GELS

(75) Inventors: James D. Burrington, Gates Mills, OH (US); Barbara P. Leffel, Huntsburg, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 1043 days.

This patent is subject to a terminal disclaimer.

(21) Appl. No.: 11/557,508

(22) Filed: Nov. 8, 2006

(65) Prior Publication Data

US 2008/0108531 A1 May 8, 2008

(51) Int. Cl.
*C10M 159/24* (2006.01)
*C10M 159/22* (2006.01)
*C10M 133/56* (2006.01)

(52) U.S. Cl. ..... 508/391; 508/574; 508/460; 508/192

(58) Field of Classification Search ..... 508/192, 508/391, 574, 460
See application file for complete search history.

(56) References Cited

U.S. PATENT DOCUMENTS

| | | | | |
|---|---|---|---|---|
| 2,310,305 | A | 2/1943 | Miller et al. | |
| 3,219,666 | A | 11/1965 | Norman et al. | 260/268 |
| 3,329,658 | A | 7/1967 | Fields | 260/78.5 |
| 3,565,804 | A | 2/1971 | Honnen et al. | 252/50 |
| 3,702,300 | A | 11/1972 | Coleman | 252/51.5 A |
| 4,234,435 | A | 11/1980 | Meinhardt et al. | 252/51.5 A |
| 5,484,542 | A | 1/1996 | Cahoon et al. | 252/18 |
| 6,482,777 | B2 | 11/2002 | Cain | 508/185 |
| 6,843,916 | B2 | 1/2005 | Burrington et al. | 210/416.5 |
| 7,534,747 | B2 * | 5/2009 | Burrington et al. | 508/113 |
| 2002/0014447 | A1 | 2/2002 | Rohrbach et al. | 210/209 |
| 2004/0266631 | A1 * | 12/2004 | Burrington et al. | 508/113 |
| 2005/0137097 | A1 | 6/2005 | George et al. | 508/291 |
| 2008/0015126 | A1 * | 1/2008 | Burrington et al. | 508/287 |

FOREIGN PATENT DOCUMENTS

| | | | |
|---|---|---|---|
| WO | WO 2004/007653 | A2 | 1/2004 |
| WO | WO 2007/024590 | A1 | 3/2007 |

OTHER PUBLICATIONS

Paul J. Flory, Principles of Polymer Chemistry (1953 Edition) pp. 308 et seq.
Parker, Dictionary of Scientific and Technical Terms, Fifth Edition, McGraw Hill © 1994.
Larson, "The Structure and Rheology of Complex Fluids", Chapter 5, Oxford University Press, New York, New York © 1999.

* cited by examiner

*Primary Examiner*—Glenn Caldarola
*Assistant Examiner*—Jim Goloboy
(74) *Attorney, Agent, or Firm*—Christopher D. Hilker; David M. Shold

(57) ABSTRACT

The present invention relates to the use of viscosity modifiers in a control release additive gel. Furthermore, the present invention relates to an additive gel containing a viscosity modifier that control releases additives into a lubricant.

14 Claims, No Drawings

VISCOSITY MODIFIERS IN CONTROLLED RELEASE LUBRICANT ADDITIVE GELS

FIELD OF THE INVENTION

The present invention relates to the use of viscosity modifiers in a controlled release additive gel. The use of viscosity modifiers improves gel formation. Furthermore, the present invention relates to an additive gel containing a viscosity modifier that control releases additives into a lubricant.

BACKGROUND OF THE INVENTION

Lubricants degrade over time through use. The additives in the lubricants deplete over the lifetime of the lubricant in a device that uses a lubricant such as an engine, machine or other mechanical devices. Replenishment of desired additives into the lubricant will improve the performance of the lubricant as well as maintaining the operations of the engine or other mechanical devices.

Time release additives for engine oils are known and are described in U.S. Pat. No. 6,843,916. A controlled release additive gel releases desired additives into the lubricant. The use of controlled release additive gel is an effective means to add fresh additives to the lubricant over time. However, there are lubricant formulations that do not gel or do not gel easily, or additives that cannot be controlled released from a lubricant additive gel.

It is desirable to produce an additive gel that otherwise would not at all, to would not easily gel for the delivery of additives into lubricants.

It is desirable to make an additive gel that has improved gel formation.

It is desirable to add viscosity modifiers to additive gels as a gel enhancer.

The present invention provides the use of viscosity modifiers in additive formulations to form a controlled release additive gel. The use of viscosity modifiers broadens the types of additives and the relative amounts of additive components which can be formed into controlled release gels. The use of viscosity modifiers of the present invention provide for the formation of the gel from additives that do not, to would not easily form a gel.

SUMMARY OF THE INVENTION

The invention provides for an additive gel composition comprising:

1) a basic component selected from the group consisting of an over based detergent, an ashless dispersant wherein the basic component has a total base number (TBN)≧13 and mixtures thereof;
2) an acid component selected from the group consisting of an acid formed from a polymer containing acidic groups in the backbone, a polyacidic compound, maleic anhydride styrene copolymers, an ashless dispersant with a TAN≧15, and mixtures thereof;
3) a viscosity modifier; and
4) optionally other lubricant additives:

resulting in an additive gel that over time releases at least one desired additive into a lubricant.

The invention further provides a process comprising:

1) contacting an additive gel with a lubricant in a device, wherein the lubricant additive gel comprises;
   a) a basic component selected from the group consisting of an over based detergent, an ashless dispersant wherein the basic component has a total base number (TBN)≧13 and mixtures thereof;
   b) an acid component selected from the group consisting of acid formed from a polymer containing acidic groups in the backbone, a polyacidic compound, maleic anhydride styrene copolymers, an ashless dispersant with a TAN≧15, and mixtures thereof;
   c) a viscosity modifier; and
   d) optionally other lubricant additives;
2) dissolving the additive gel in the lubricant over time.

The use of the viscosity modifier in the formulation improves gel formation. Further, the use of the viscosity modifier allows gels to be formed from otherwise difficult-to-gel components to components that do not otherwise gel.

DETAILED DESCRIPTION OF THE INVENTION

The present invention provides for the use of a viscosity modifier for gel formation in a controlled release additive gel for delivery of additives into a lubricant.

The controlled release additive gel composition comprises:

1) a basic component selected from the group consisting of an over based detergent, an ashless dispersant wherein the basic component has a total base number (TBN)≧13 and mixtures thereof;
2) an acid component selected from the group consisting of acid formed from a polymer containing acidic groups in the backbone, a polyacidic compound, maleic anhydride styrene copolymers, an ashless dispersant with a TAN≧15, and mixtures thereof;
3) a viscosity modifier; and
4) optionally other lubricant additives.

The weight ratio of the basic component (component 1 above) to the acid component (component 2 above) is about 0.01 to about 100, and in another embodiment about 0.1 to about 10 and in another embodiment about 0.2 to about 5.

The weight ratio of the viscosity modifier (component 3 above) to the total gel (component 1, 2, 3 and 4 above) is about 0.001 to about 0.99 and in another embodiment about 0.01 to about 0.5 and in another embodiment about 0.1 to about 0.15.

The weight ratio of the optional lubricant additives (component 4 above) to the total gel (component 1, 2, 3 and 4 above) is about 0.001 to about 0.99 and in another embodiment is about 0.01 to about 0.5.

The lubricant additives are in the form of a gel. The gel control releases the additive into the lubricant over time. Gels are materials that comprise mixtures of two or more substances and which exist in a semi-solid state more like a solid than a liquid, see Parker, Dictionary of Scientific and Technical Terms, Fifth Edition, McGraw Hill, © 1994. See, also, Larson. "The Structure and rheology of Complex Fluids", Chapter 5, Oxford University Press, New York, N.Y., © 1999, each which is incorporated herein by reference. The rheological properties of a gel can be measured by small amplitude oscillatory shear testing. This technique measures the structural character of the gel and produces a term called the storage modulus which represents storage of elastic energy and the loss modulus which represents the viscous dissipation of that energy. The ratio of the loss modulus/storage modulus, which is called the loss tangent, or "tan delta", is ≧1 for materials that are liquid-like and ≦1 for materials that are solid-like. The additive gels of the present invention have tan delta values in one embodiment of about ≦0.75, in another embodiment of about ≦0.5 and in another embodiment of about ≦0.3. The additive gels have tan delta values in one embodiment of about ≦1, in one embodiment of about ≦0.75, in one embodiment of about ≦0.5 or in one embodiment of about ≦0.3.

The additive gel includes combining a basic component, an acid component, and a viscosity modifier. The viscosity modifier broadens the types of additives and the relative amounts of additive components which can be made into a control release gel. The viscosity modifier provides for the use of gel breaking surfactants as an optional lubricant additive. The gel breaking surfactants include glycerol monoleate, other fatty acids including tall oil fatty acid, linoleic and stearic acids and derivatives thereof such as esters, amides and imides, amines and alcohols, non-ionic surfactants such as polyether and poly ether amines such as polypropylene oxide amine, and the like. The viscosity modifier provides for the use of low viscosity materials to be components of the control release gel. The relative amounts of the low viscosity materials can be greater in the control release gel of the present invention due to the viscosity modifier in the control release gel. The low viscosity materials include mineral oil synthetic oils including poly alpha olefins, low viscosity lubricant additives including borate esters such as triethyl borate, and the like.

The basic component includes over based detergents, ashless dispersants and the like. The basic component has a total base number (TBN)≧13.

The detergents include over based sulfonates, phenates, salicylates, carboxylates, over based calcium sulfonate detergents which are commercially available, over based detergents containing metals such as Mg, Ba, Sr, Na, Ca and K and mixtures thereof and the like.

Detergents are described, for example, in U.S. Pat. No. 5,484,542 which is incorporated herein by reference. The detergents may be used alone or in combination. Detergents are described, for example, in U.S. Pat. No. 5,484,542 which is incorporated herein by reference.

The ashless dispersant includes Mannich dispersants, polymeric dispersants, carboxylic dispersants, amine dispersants, and combinations and mixtures thereof. In one embodiment the ashless dispersants are substantially free of forming ash to completely free of forming ash. In one embodiment the preferred dispersant is polyisobutenyl succinimide dispersant.

Ashless type dispersants are characterized by a polar group attached to a relatively high molecular weight hydrocarbon chain. Typical ashless dispersants include N-substituted long chain alkenyl succinimides, having a variety of chemical structures including typically:

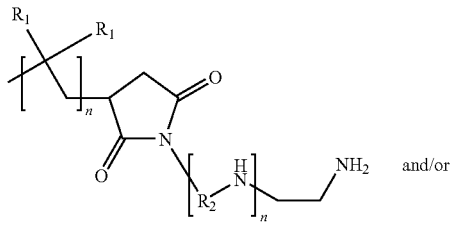

and/or

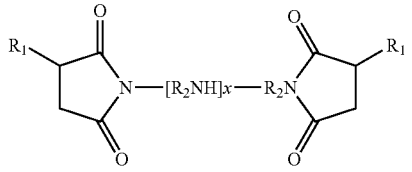

wherein each $R^1$ is independently an alkyl group, frequently a polyisobutyl group, with a molecular weight of 500-5000, and $R^2$ are alkenylene groups, commonly ethylene ($C_2H_4$) groups. Succinimide dispersants are more fully described in U.S. Pat. No. 4,234,435 which is incorporated herein by reference. The dispersants described in this patent are particularly effective for producing a gel in accordance with the present invention.

The ashless dispersant includes, but is not limited to, an ashless dispersant such as a polyisobutenyl succinimide and the like. Polyisobutenyl succinimide ashless dispersants are commercially available products which are typically made by reacting together polyisobutylene having a number average molecular weight ("Mn") of about 300 to 10,000 with maleic anhydride to form polyisobutenyl succinic anhydride ("PIBSA") and then reacting the product so obtained with a polyamine typically containing 1 to 10 ethylene amino groups per molecule. The dispersant so obtained is typically formed from a mixture of different compounds and can be characterized by a variety of different variables including the degree of its amine substitution (i.e., the ratio of the equivalents of amino groups to carbonylic groups, or the N:CO ratio), its maleic anhydride conversion level (i.e., its molar ratio of maleic anhydride to PIB, as defined in U.S. Pat. No. 4,234,435, incorporated herein by reference), the Mn of its PIB group, and its mode of preparation (thermal assisted succination vs. $Cl_2$-assisted succination). Analogous compounds made with other polyamines (e.g. polypropenyl) can also be used. Ashless dispersants of this type are described, for example, in U.S. Pat. No. 4,234,435, which is incorporated herein by reference.

Normally, the N:CO ratio of these polyisobutenyl succinimide ashless dispersants will be about 0.6 to 1.6 more typically about 0.7 to 1.4 or even 0.7 to 1.2. In addition or alternatively, the maleic anhydride conversion level of these polyisobutenyl succinimide ashless dispersants will normally be about 1.3, more typically at least 1.5 or even 1.6 or above. In addition or alternatively, the Mn of the polyisobutenyl segments of these polyisobutenyl succinimide ashless dispersants are normally ≧about 350, more typically at least 1200, at least about 1500 or even 1800 or above. In addition or alternatively, these polyisobutenyl succinimide ashless dispersants are also made using $Cl_2$-assisted succination rather than thermal assisted succination, since this produces PISAs of higher conversion than thermally produced PIBSAs (the latter known as DA or direct addition PIBSAs).

The Mannich dispersant are the reaction products of alkyl phenols in which the alkyl group contains at least about 30 carbon atoms with aldehydes (especially formaldehyde) and amines (especially polyalkylene polyamines). Mannich bases having the following general structure (including a variety of different isomers and

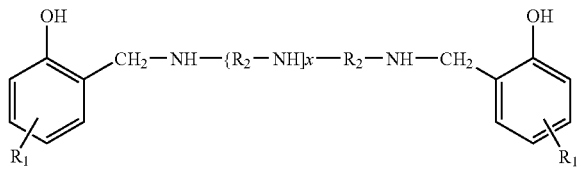

the like) are especially interesting.

and/or

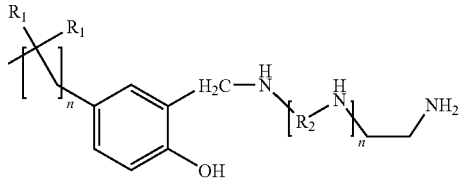

Another class of ashless dispersants is nitrogen containing carboxylic dispersants. Examples of these "carboxylic dispersants" are described in Patent U.S. Pat. No. 3,219,666.

Amine dispersants are reaction products of relatively high molecular weight aliphatic halides and amines, preferably polyalkylene polyamines. Examples thereof are described, in U.S. Pat. No. 3,565,804.

Polymeric dispersants are interpolymers of oil-solubilizing monomers such as decyl methacrylate, vinyl decyl ether and high molecular weight olefins with monomers containing polar substituents, e.g., amino alkyl acrylates or acrylamides and poly-(oxyethylene)-substituted acrylates. Examples of polymer dispersants thereof are disclosed in the following U.S. Pat. Nos. 3,329,658 and 3,702,300.

Dispersants can also be post-treated by reaction with any of a variety of agents. Among these are urea, thiourea, dimercaptothiazoles, carbon disulfide, aldehydes, ketones, carboxylic acids, hydrocarbon-substituted succinic anhydrides, nitrites, expoxides, boron compounds, and phosphorus compounds.

The basic component can be used alone or in combination. The basic component is present in the range from about 0.01 wt % to about 99 wt % gel, in another embodiment in the range from about 1 wt % to about 70 wt % gel, and in another embodiment in the range from about 5 wt % to about 50 wt % total weight of the gel.

The acid component includes acids formed from a polymer containing acidic groups in the backbone, a polyacid, ashless dispersant, maleic anhydride styrene copolymer and the like.

The ashless dispersant of the acid component (component 2) can be the same or a different ashless dispersant as described above for the basic component (component 1) so long as the ashless dispersant has a TAN≧15 when it is the acid component.

The acid includes a polymer containing acidic groups in the backbone, for example, polymers derived from styrene and maleic anhydride, polymers derived from acrylates including acrylic acid, acrylic acid esters, methacrylic acid and its esters, polymers derived from high molecular weight (Cn wherein n≦12) esters and acids, polymers derived from esterified maleic anhydride styrene copolymers, polymers derived from esterified ethylene diene monomer copolymer; surfactants with acidic groups in the backbone; emulsifiers with acidic groups in the backbone; polyacidic compounds, for example, polyacidic surfactants and/or polyacidic dispersants; functionalized derivatives of each component listed herein and mixtures thereof.

The acid includes maleic anhydride styrene copolymer wherein the copolymer is partially esterifies with $C_6$ to $C_{32}$ alcohol or mixtures of alcohol and in one embodiment $C_8$ to $C_{18}$ alcohol; and the equivalent ratio of alcohol to acid groups is from about 0 to about 0.99 and in another embodiment about 0.4 to about 0.75; and wherein the TAN is ≧1 and in another embodiment ≧3 (e.g., kOH/g) and the oil blend viscosity is at about 10% oil is ≧5cST+@ about 100° C., in one embodiment ≧10cSt @ about 100° C.

The ashless dispersant includes ashless dispersants only with TAN≧15.

In one embodiment, the acid is formed from the polymerization of styrene and maleic anhydride. In one embodiment, the copolymer is partially esterified with one or more $C_6$ to $C_{32}$ alcohol or mixture of alcohols and in another embodiment $C_8$ to $C_{18}$ alcohols. The equivalent ratio of alcohol to acid groups is from about 0.1 wt % to about 0.99 wt % and in another embodiment about 0.45 wt % to about 0.95 wt %. In one embodiment, the polyacidic surfactants include a maleinated (olefin copolymer of ethylene and propylene) (OCP). In another embodiment, the polyacidic surfactants include di-isobutenyl succan from the reaction of di-isobutylene and maleic anhydride. In one embodiment, the polyacidic dispersants include a succinimide resulting from reaction of <1 equivalent of an ethylene diamine polyamine with the maleinated OCP. In another embodiment, the polyacidic dispersants include a succinimide resulting from reaction of <1 equivalent of an ethylene diamine polyamine with di-isobutenyl succan. The TAN is ≧1, in another embodiment the TAN is ≧3 (e.g. koH/g and the oil blend viscosity at about 10% oil is 75 cSTO 100C and in another embodiment 10cST o100C. In one embodiment, the acid must have residual acid groups with a total acid number ≧1 and in another embodiment ~3.

The acids can be used alone or in combination. The acid is present in the range from about 0.01 wt % to about 99 wt %, in one embodiment in the range from about 0.1 wt % to about 90 wt %, and in another embodiment in the range from about 1 wt % to about 80 wt % of the total weight of the gel.

The viscosity modifier (component 3) includes polyolefins such as polyethylenes, polypropylenes, polyalphaolefins, ethylene-propylene copolymers and malenated derivatives thereof and the like; polyisobutylenes, maleic anhydride and their diene derivatives and the like; polymethacrylates; and maleic anhydride-styrene copolymers and esters and their diene derivatives and the like; and mixtures thereof.

Viscosity modifiers include hydrogenated copolymers of styrene-butadiene, ethylene-propylene copolymers, polyisobutenes, hydrogenated styrene-isoprene polymers, hydrogenated isoprene polymers, polymethacrylates, polyacrylates, polyalkyl styrenes, alkenyl aryl conjugated diene copolymers, polyolefins, and esters of maleic anhydride-styrene copolymers.

Viscosity modifiers include functionalized polyolefins, for example, ethylene-propylene copolymers that have been functionalized with the reaction product of maleic anhydride and an amine, a polymethacrylate functionalized with an amine, or styrene-maleic anhydride copolymers reacted with an amine.

PMA's

The polymethacrylate polymeric viscosity modifier includes a copolymer derived from a (meth)acrylate monomer containing an alkyl group with 1 to 30 carbon atoms, in one embodiment 1 to 26 carbon atoms and in another embodiment 1 to 20 carbon atoms.

The (meth)acrylate monomer includes those derived from natural or synthetic sources. When derived by synthetic sources the (meth)acrylate monomer may be prepared using well known direct esterification and/or transesterification techniques.

As used herein the term (meth)acrylate means acrylate or methacrylate units. The alkyl(meth)acrylate includes for example compounds derived from saturated alcohols, such as methyl methacrylate, butyl methacrylate, 2-methylpentyl, 2-propylheptyl, 2-butyloctyl, 2-ethylhexyl(meth)acrylate, octyl(meth)acrylate, nonyl (meth)acrylate, isooctyl(meth) acrylate, isononyl(meth)acrylate, 2-tert-butylheptyl (meth) acrylate, 3-isopropylheptyl(meth)acrylate, decyl(meth)acrylate, undecyl (meth)acrylate, 5-methylundecyl(meth) acrylate, dodecyl(meth)acrylate, 2-methyldodecyl(meth) acrylate, tridecyl(meth)acrylate, 5-methyltridecyl (meth) acrylate, tetradecyl(meth)acrylate, pentadecyl(meth) acrylate, hexadecyl (meth)acrylate, 2-methylhexadecyl (meth)acrylate, heptadecyl(meth)acrylate, 5-isopropylheptadecyl(meth)acrylate, 4-tert-butyloctadecyl (meth)acrylate, 5-ethyloctadecyl(meth)acrylate, 3-isopropyloctadecyl-(meth)acrylate, octadecyl (meth acrylate, nonadecyl(meth acrylate, eicosyl(meth)acrylate, cetyleicosyl (meth) acrylate, stearyleicosyl(meth)acrylate, docosyl(meth) acrylate and/or eicosyltetratriacontyl(meth)acrylate; (meth) acrylates derived from unsaturated alcohols, such as oleyl (meth)acrylate; and cycloalkyl(meth)acrylates, such as 3-vinyl-2-butylcyclohexyl(meth)acrylate or bornyl(meth) acrylate.

The alkyl(meth)acrylates with long-chain alcohol-derived groups may be obtained, for example, by reaction of a (meth) acrylic acid (by direct esterification) or methyl methacrylate (by transesterification) with long-chain fatty alcohols, in which reaction a mixture of esters such as (meth)acrylate with alcohol groups of various chain lengths is generally obtained. These fatty alcohols include Oxo Alcohol® 7911, Oxo Alcohol® 7900 and Oxo Alcohol® 1100 of Monsanto; Alphanol® 79 of ICI; Nafol® 1620, Alfol® 610 and Alfol® 810 of Condea (now Sasol); Epal® 610 and Epal® 810 of Ethyl Corporation; Linevol® 79, Linevol® 911 and Dobanol® 25 μL of Shell AG; Lial® 125 of Condea Augusta, Milan; Dehydad® and Lorol® of Henkel KGaA (now Cognis) as well as Linopol® 7-11 and Acropol® 91 of Ugine Kuhlmann.

MSC's (May also be Referred to as an Interpolymer)

In one embodiment the viscosity modifier is derived from the esterified polymer comprising: (i) a vinyl aromatic monomer; and (ii) an unsaturated carboxylic acid or derivatives thereof. The esterified polymers of this type are generally referred to as an interpolymer. In one embodiment the esterified polymer is substantially free of to free of a (meth)acrylate ester. In one embodiment the esterified polymer is a styrene-maleic anhydride copolymer. In one embodiment the esterified polymer further contains a nitrogen derived from a nitrogen containing compound capable of reacting with a functionalized polymer backbone.

The molecular weight of the interpolymer may also be expressed in terms of the "reduced specific viscosity" of the polymer which is a widely recognized means of expressing the molecular size of a polymeric substance. As used herein, the reduced specific viscosity (abbreviated as RSV) is the value obtained in accordance with the formula RSV=(Relative Viscosity-1)/Concentration, wherein the relative viscosity is determined by measuring, by means of a dilution viscometer, the viscosity of a solution of about 1 g of the polymer in about 10 $cm^3$ of acetone and the viscosity of acetone at about 30° C. For purpose of computation by the above formula, the concentration is adjusted to about 0.4 g of the interpolymer per 10 $cm^3$ of acetone. A more detailed discussion of the reduced specific viscosity, also known as the specific viscosity, as well as its relationship to the average molecular weight of an interpolymer, appears in Paul J. Flory, Principles of Polymer Chemistry, (1953 Edition) pages 308 et seq. The interpolymer polymer of the invention may have a RSV from about above 0.05 to about above 2 in one embodiment about 0.06 to about 1 and in another embodiment about 0.06 to about 0.8. In one embodiment the RSV is about 0.69. In another embodiment the RSV is about 0.12.

Suitable examples of a vinyl aromatic monomers include styrene (often referred to as ethenylbenzene), substituted styrene or mixtures thereof. Substituted styrene monomers include functional groups such as a hydrocarbyl group, halo-, amino-, alkoxy-, carboxy-, hydroxy-, sulphonyl- or mixtures thereof. The functional groups include those located at the ortho, meta or para positions relative to the vinyl group on the aromatic monomer, the functional groups are located at the ortho or para position being especially useful. In one embodiment the functional groups are located at the para position. Halo-functional groups include chlorine, bromine, iodine or mixtures thereof. In one embodiment the halo functional group is chlorine or mixtures thereof. Alkoxy functional groups may contain 1 to about 10 carbon atoms, in one embodiment 1 to about 8 carbon atoms, in another embodiment 1 to about 6 carbon atoms and in yet another embodiment 1 to about 4 carbon atoms. Alkoxy functional groups containing 1 to about 4 carbon atoms is referred to as lower alkoxy styrene.

The hydrocarbyl group includes ranges from 1 to about 30 carbon atoms, in one embodiment 1 to about 20 carbon atoms, in another embodiment 1 to about 15 carbon atoms and in yet another embodiment 1 to about 10 carbon atoms. Examples of a suitable hydrocarbyl group on styrene monomers include alpha-methylstyrene, para-methylstyrene (often referred to as vinyl toluene), para-tert-butylstyrene, alpha-ethylstyrene, para-lower alkoxy styrene or mixtures thereof.

OCP+EPC VM's

In one embodiment the viscosity modifier may be derived from an olefin copolymer.

In one embodiment the olefin copolymer which serves as a viscosity modifier is derived from an ethylene monomer and at least one other comonomer derived from an alpha-olefin having the formula $H_2C{=}CHR^1$, wherein $R^1$ is a hydrocarbyl group, especially an alkyl radical. In several embodiments the alkyl radical contains 1 to 30, 1 to 10, 1 to 6 or 1 to 3 carbon atoms. The hydrocarbyl group includes an alkyl radical that has a straight chain, a branched chain or mixtures thereof. Examples of comonomers include propylene, 1-butene, 1-hexene, 1-octene, 4-methyl-1-pentene, 1-decene or mixtures thereof. In one embodiment the comonomer includes 1-butene, propylene or mixtures thereof. Examples of the olefin copolymers include ethylene-propylene copolymers, ethylene-1-butene copolymers or mixtures thereof.

In other embodiments the alpha-olefin includes a comonomer with 6 to 40, 10 to 34 or 14 to 22 carbon atoms. Examples of alpha-olefins include 1-decene 1-undecene, 1-dodecene, 1-tridecene, 1-butadecene, 1-pentadecene, 1-hexadecene, 1-heptadecene 1-octadecene, 1-nonadecene, 1-eicosene, 1-doeicosene, 2-tetracosene, 3-methyl-1-henicosene, 4-ethyl-2-tetracosene or mixtures thereof or reactive equivalents thereof. Useful examples of alpha-olefins include 1-pentadecene, 1-hexadecene, 1-heptadecene 1-octadecene, 1-nonadecene or mixtures thereof. The alpha-olefins are often commercially available as mixtures, especially as mixtures of $C_{16}$-$C_{18}$ alpha olefins.

In one embodiment the olefin copolymer is an ethylene-propylene copolymer and may contain up to 3, 4 or 5 monomer types, that is, it may contain additional monomers beside ethylene and propylene. The composition of the ethylene-propylene copolymer in several embodiments has an ethylene content from about 15 wt % to about 90 wt %, in another embodiment about 30 wt % to about 80 wt % of the copolymer; and a propylene content of about 10 wt % to about 85 wt %, in another embodiment about 20 wt % to about 70 wt % of the copolymer. In one embodiment olefin copolymer is an ethylene-propylene copolymer, with the ethylene content ranging from about 15 wt % to about 90 wt % of the copolymer and the propylene content ranging from about 10 wt % to about 85 wt % of the copolymer.

Polyisobutylene

In one embodiment the viscosity modifier may be a polyisobutylene (PIB). Polyisobutylene is a commercially available material. The PIB used in the present formulations is a viscous oil-miscible liquid, with a weight molecular weight in the range of about 1,000 to about 8,000, in another embodiment about 1,500 to about 6,000, and a viscosity in the range of typically about 2,000 to about 6,000 cS(100 C) (ASTMD-445). In most cases, the molecular weight will be in the range of about 2,000 (to about 5,000 and the kinematic viscosity should be selected to be in the range of about 3,000 to about 4,500 cS. The more viscous PIB's may be used to provide a greater contribution to product viscosity than the less viscous ones, and may therefore be used preferentially with the lighter neutral base stocks, for example, the about 300 to about 500 SUS neutrals. In addition, the higher viscosity PIB's e.g., the PIB's of over about 4,000 cS viscosity may be used in lower amounts, resulting in improved product economics.

The viscosity modifiers may be used alone or in combination. The viscosity modifier may be present in the range of about 0.1 wt % to about 99 wt %, in another embodiment in the range of about 0.1 wt % to about 50 wt % and in another embodiment in the range of about 1 wt % to about 15 wt % of the total weight of the gel.

Typically, the additive gel further contains at least one desired additive (component 4) for control release into the lubricant. In one embodiment the additive gel may contain one or more desired additives for control release from the gel into the lubricant. The additive gel components for release include viscosity modifier(s), friction modifier(s), ashless detergent(s), cloud point depressant(s), pour point depressant's), demulsifier(s), flow improver(s), anti static agent(s), ashless dispersant(s), ashless antioxidant(s), antifoam(s), corrosion/rust inhibitor(s), extreme pressure/antiwear agent(s), seal swell agent(s), lubricity aid(s), antimisting agent(s), and mixtures thereof, resulting in a controlled release gel that over time releases the desired additive(s) into the lubricant when the gel is in contact with the lubricant. The desired additive component is further determined by the lubricant formulation, desired performance characteristics, function and the like and further what additive is desired to be added due to depleted additives and/or added as a new additive due to desired functions and/or characteristics.

In one embodiment, the desired additive optional components of the ashless detergent, ashless dispersant, and/or ashless antioxidants are compounds that contain a base component which is an acid neutralizing component that may be free of ash containing components. Examples of ashless include, but are not limited to, high nitrogen to carbonyl (≦1:1) dispersants; nitrogen containing antioxidants such as substituted biphenyl amines, organic amines such as C 5 to C 36 amines, ethoxylated amines and the like. The ashless detergents, ashless dispersants and/or ashless antioxidants have a TBN which is ≧11 in another embodiment the TBN is ≧10 and in another embodiment the TBN is ≧50.

Ashless antioxidants include alkyl-substituted phenols such as 2,6-di-tertiary butyl-4-methyl phenol, phenate sulfides, phosphosulfurized terpenes, sulfurized esters, aromatic amines, diphenyl amines, alkylated diphenyl amines and hindered phenols, bis-nonylated diphenylamine, nonyl diphenylamine, octyl diphenylamine, bis-octylated diphenylamine, bis-decylated diphenylamine, decyl diphenylamine and mixtures thereof.

The ashless antioxidant function includes sterically hindered phenols and includes but is not limited to 2,6-di-tert-butylphenol, 4-methyl-2,6-di-tert-butylphenol, 4-ethyl-2,6-di-tert-butylphenol, 4-propyl-2,6-di-tert-butyl phenol, 4-butyl-2,6-di-tert-butylphenol 2,6-di-tert-butylphenol, 4-pentyl-2-6-di-tert-butylphenol, 4-hexyl-2,6-di-tert-butylphenol, 4-heptyl-2,6-di-tert-butylphenol, 4-(2-ethylhexyl)-2,6-di-tert-butylphenol, 4-octyl-2,6-di-tert-butylphenol, 4-nonyl-2,6-di-tert-butylphenol, 4-decyl-2,6-di-tert-butylphenol, 4-undecyl-2,6-di-tert-butylphenol, 4-dodecyl-2,6-di-tert-butylphenol, 4-tridecyl-2,6-di-tert-butylphenol, 4-tetradecyl-2,6-di-tert-butylphenol, methylene-bridged sterically hindered phenols include but are not limited to 4,4-methylenebis(6-tert-butyl-o-cresol), 4,4-methylenebis (2-tert-amyl-o-cresol), 2,2-methylenebis(4-methyl-6-tert-butylphenol), 4,4-methylene-bis(2,6-di-tertbutylphenol) and mixtures thereof.

Another example of an ashless antioxidant is a hindered, ester-substituted phenol, which can be prepared by heating a 2,6-dialkylphenol with an acrylate ester under based conditions, such as aqueous KOH.

Ashless antioxidants may be used alone or in combination. The antioxidants are typically present in the range of about 0 wt % to about 95 wt %, in one embodiment in the range from about 0.01 wt % to 95 wt % and in another embodiment in the range from about 1 wt % to about 70 wt % and in another embodiment in the range from about 5 wt % to about 60 wt % total weight of the gel. The extreme pressure/anti-wear agents include a sulfur or chlorosulphur EP agent, a chlorinated hydrocarbon EP agent, or a phosphorus EP agent, or mixtures thereof. Examples of such EP agents are amine salts of phosphorus acid, chlorinated wax, organic sulfides and polysulfides, such as benzyldisulfide, bis-(chlorobenzyl) disulfide, dibutyl tetrasulfide, sulfurized sperm oil, sulfurized methyl ester of oleic acid sulfurized alkylphenol, sulfurized dipentene, sulfurized terpene, and sulfurized Diels-Alder adducts; phosphosulfurized hydrocarbons, such as the reaction product of phosphorus sulfide with turpentine or methyl oleate, phosphorus esters such as the dihydrocarbon and trihydrocarbon phosphate, i.e., dibutyl phosphate, diheptyl phosphate, dicyclohexyl phosphate, pentylphenyl phosphate; dipentylphenyl phosphate, tridecyl phosphate, distearyl phosphate and polypropylene substituted phenol phosphate, metal thiocarbamates, such as zinc dioctyldithiocarbamate and barium heptylphenol diacid, such as zinc dicyclohexyl phosphorodithioate and the zinc salts of a phosphorodithioic acid combination may be used and mixtures thereof.

In one embodiment the antiwear agent/extreme pressure agent comprises an amine salt of a phosphorus ester acid. The amine salt of a phosphorus ester acid includes phosphoric acid esters and salts thereof; dialkyldithiophosphoric acid esters and salts thereof; phosphites; and phosphorus-containing carboxylic esters, ethers, and amides; and mixtures thereof.

In one embodiment the phosphorus compound further comprises a sulfur atom in the molecule. In one embodiment the amine salt of the phosphorus compound is ashless, i.e., metal-free (prior to being mixed with other components).

The amines which may be suitable for use as the amine salt include primary amines, secondary amines, tertiary amines, and mixtures thereof. The amines include those with at least one hydrocarbyl group, or, in certain embodiments, two or three hydrocarbyl groups. The hydrocarbyl groups may contain about 2 to about 30 carbon atoms, or in other embodiments about 8 to about 26 or about 10 to about 20 or about 13 to about 19 carbon atoms.

Primary amines include ethylamine, propylamine, butylamine, 2-ethylhexylamine, octylamine, and dodecylamine, as well as such fatty amines as n-octylamine, n-decylamine, n-dodecylamine, n-tetradecylamine, n-hexadecylamine, n-octadecylamine and oleylamine. Other useful fatty amines include commercially available fatty amines such as "Armeen®" amines (products available from Akzo Chemicals, Chicago, Ill.), such as Armeen C, Armeen O, Armeen OL, Armeen T, Armeen HT, Armeen S and Armeen SD, wherein the letter designation relates to the fatty group, such as coco, oleyl, tallow, or stearyl groups.

Examples of suitable secondary amines include dimethylamine, diethylamine, dipropylamine, dibutylamine, diamylamine, dihexylamine, diheptylamine, methylethylamine, ethylbutylamine and ethylamylamine. The secondary amines may be cyclic amines such as piperidine, piperazine and morpholine.

The amine may also be a tertiary-aliphatic primary amine. The aliphatic group in this case may be an alkyl group containing about 2 to about 30, or about 6 to about 26, or about 8 to about 24 carbon atoms. Tertiary alkyl amines include monoamines such as tert-butylamine, tert-hexylamine, 1-methyl-1-amino-cyclohexane, tert-octylamine, tert-decylamine, tert-dodecylamine, tert-tetradecylamine, tert-hexadecylamine, tert-octadecylamine, tert-tetracosanylamine, and tert-octacosanylamine.

Mixtures of amines may also be used in the invention. In one embodiment a useful mixture of amines is "Primene® 81R" and "Primene® JMT." Primene® 81R and Primene® JMT (both produced and sold by Rohm & Haas) are mixtures of C11 to C14 tertiary alkyl primary amines and C18 to C22 tertiary alkyl primary amines respectively.

Suitable hydrocarbyl amine salts of alkylphosphoric acid may be represented by the following formula:

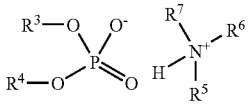

wherein $R^3$ and $R^4$ are independently hydrogen or hydrocarbyl groups such as alkyl groups; for the phosphorus ester acid, at least one of $R^3$ and $R^4$ will be hydrocarbyl. $R^3$ and $R^4$ may contain about 4 to about 30, or about 8 to about 25, or about 10 to about 20, or about 13 to about 19 carbon atoms. $R^5$, $R^6$ and $R^7$ may be independently hydrogen or hydrocarbyl groups, such as alkyl branched or linear alkyl chains with 1 to about 30, or about 4 to about 24, or about 6 to about 20, or about 10 to about 16 carbon atoms. These $R^5$, $R^6$ and $R^7$ groups may be branched or linear groups, and in certain embodiments at least one, or alternatively two of $R^5$, $R^6$ and $R^7$ are hydrogen. Examples of alkyl groups suitable for $R^5$, $R^6$, and $R^7$ include butyl, sec-butyl, isobutyl, tert-butyl, pentyl, n-hexyl, sec-hexyl, n-octyl, 2-ethylhexyl, decyl, undecyl, dodecyl, tridecyl, tetradecyl, pentadecyl, hexadecyl, heptadecyl, octadecyl, octadecenyl, nonodecyl, eicosyl group is and mixtures thereof.

In one embodiment the hydrocarbyl amine salt of an alkylphosphoric acid ester is the reaction product of a C14 to C18 alkylated phosphoric acid with Primene 81R™ (produced and sold by Rohm & Haas) which is a mixture of C11 to C14 tertiary alkyl primary amines.

Similarly, hydrocarbyl amine salts of dialkyldithiophosphoric acid esters of the invention used in the rust inhibitor package may be represented by the formula:

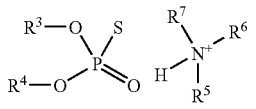

wherein the various R groups are as defined above, although typically both R groups are hydrocarbyl or alkyl. Examples of hydrocarbyl amine salts of dialkyldithiophosphoric acid esters include the reaction product(s) of hexyl, heptyl or octyl or nonyl, 4-methyl-2-pentyl or 2-ethylhexyl, isopropyl dithiophosphoric acids with ethylene diamine, morpholine, or Primene 81R™, and mixtures thereof.

In one embodiment the dithiophosphoric acid may be reacted with an epoxide or a glycol. This reaction product is further reacted with a phosphorus acid, anhydride, or lower ester. The epoxide includes an aliphatic epoxide or a styrene oxide. Examples of useful epoxides include ethylene oxide, propylene oxide, butene oxide, octene oxide, dodecene oxide, styrene oxide and the like. In one embodiment the epoxide is Propylene oxide. The glycols may be aliphatic glycols having from 1 to about 12, or from about 2 to about 6, or about 2 to about 3 carbon atoms. The dithiophosphoric acids, glycols, epoxides, inorganic phosphorus reagents and methods of reacting the same are described in U.S. Pat. Nos. 3,197,405 and 3,544,465. The resulting acids may then be salted with amines. An example of suitable dithiophosphoric acid is prepared by adding phosphorus pentoxide (about 64 grams) at about 58° C. over a period of about 45 minutes to about 514 grams of hydroxypropyl O,O-di(4-methyl-2-pentyl)phosphorodithioate (prepared by reacting di(4-methyl-2-pentyl)-phosphorodithioic acid with about 1.3 moles of propylene oxide at about 25° C.). The mixture is heated at about 75° C. for about 2.5 hours, mixed with a diatomaceous earth and filtered at about 70° C. The filtrate contains about 11.8% by weight phosphorus, about 15.2% by weight sulfur, and an acid number of 87 (bromophenol blue).

The EP/antiwear agents are present in the range of about 0 wt % to about 50 wt %, in one embodiment in the range from about 0.25 wt % to about 25 wt % and in another embodiment in the range from about 0.5 wt % to about 10 wt % total weight of the gel.

The antifoams include organic silicones such as poly dimethyl siloxane, poly ethyl siloxane, polydiethyl siloxane, polyacrylates and polymethacrylates, trimethyl-triflouropropylmethyl siloxane and the like.

The antifoams include organic silicones such as poly dimethyl siloxane, poly ethyl siloxane, polydiethyl siloxane, polyacrylates and polymethacrylates, trimethyl-triflouropropylmethyl siloxane and the like.

The antifoams may be used alone or in combination. The antifoams are used in the range of about 0 wt % to about 20 wt %, in one embodiment in the range of about 0.02 wt % to about 10 wt % and in another embodiment in the range of 0.05 wt % to about 2.5 w t % total weight of the gel.

The viscosity modifier provides both viscosity improving properties and dispersant properties. Examples of dispersant-viscosity modifiers include vinyl pyridine, N-vinyl pyrrolidone and N,N'-dimethylaminoethyl methacrylate are examples of nitrogen-containing monomers and the like.

Polyacrylates obtained from the polymerization or copolymerization of one or more alkyl acrylates also are useful as viscosity modifiers.

Functionalized polymers can also be used as viscosity modifiers. Among the common classes of such polymers are olefin copolymers and acrylate or methacrylate copolymers. Functionalized olefin copolymers can be, for instance, interpolymers of ethylene and propylene which are grafted with an active monomer such as maleic anhydride and then derivatized with an alcohol or an anine. Other such copolymers are copolymers of ethylene and propylene which are reacted or grafted with nitrogen compounds. Derivatives of polyacrylate esters are well known as dispersant viscosity index modifiers additives. Dispersant acrylate or polymethacrylate viscosity modifiers such as Acryloid™ 985 or Viscoplex™ 6-054, from RohMax, are particularly useful. Solid, oil-soluble polymers such as the PIB (polyisobutylene), methacrylate, polyalkystyrene, ethylene/propylene and ethylene/propylene/1,4-hexadiene polymers and maleic anhydride-styrene interpolymer and derivatives thereof, can also be used as viscosity index improvers. The viscosity modifiers are known and commercially available.

The viscosity modifiers may be used alone or in combination. The viscosity modifiers are present in the range of about 0 wt % to 80 wt %, in one embodiment in the range from about 0.25 wt % to about 50 wt % and in another embodiment in the range from about 0.5 wt % to about 10 wt % total weight of the gel.

The friction modifiers include organo-molybdenum compounds, including molybdenum dithiocarbamates, and fatty acid based materials, including those based on oleic acid, including glycerol mono-oleate, those based on stearic acid, and the like.

In one embodiment, the friction modifier is a phosphate ester or salt including a monohydrocarbyl, dihydrocarbyl or a trihydrocarbyl phosphate, wherein each hydrocarbyl group is saturated. In several embodiments, each hydrocarbyl group contains from about 8 to about 30, or from about 12 up to about 28, or from about 14 up to about 24, or from about 14 up to about 18 carbons atoms. In another embodiment, the hydrocarbyl groups are alkyl groups. Examples of hydrocarbyl groups include tridecyl, tetradecyl, pentadecyl, hexadecyl, heptadecyl, octadecyl groups and mixtures thereof.

In one embodiment, the phosphate salts may be prepared by reacting an acidic phosphate ester with an amine compound or a metallic base to form an amine or a metal salt. The amines may be monoamines or polyamines. Useful amines include those amines disclosed in U.S. Pat. No. 4,234,435 at Col. 21, line 4 to Col. 27, line 50.

Useful amines include primary ether amines, such as those represented by the formula, $R''(OR')_x—NH_2$, wherein R' is a divalent alkylene group having about 2 to about 6 carbon atoms; x is a number from one to about 150, or from about one to about five, or one; and R" is a hydrocarbyl group of about 5 to about 150 carbon atoms.

The phosphate salt may be derived from a polyamine. The polyamines include alkoxylated diamines, fatty polyamine diamines, alkylenepolyamines, hydroxy containing polyamines, condensed polyamines, alkylenepolyamines, and heterocyclic polyamines.

The metal salts of the phosphorus acid esters are prepared by the reaction of a metal base with the acidic phosphorus ester. The metal base may be any metal compound capable of forming a metal salt. Examples of metal bases include metal oxides, hydroxides, carbonates, borates, or the like. Suitable metals include alkali metals, alkaline earth metals and transition metals. In one embodiment, the metal is a Group IIA metal, such as calcium or magnesium, Group IIB metal, such as zinc, or a Group VIIB metal, such as manganese. Examples of metal compounds which may be reacted with the phosphorus acid include zinc hydroxide, zinc oxide, copper hydroxide or copper oxide.

In one embodiment, the friction modifier is a phosphite and may be a monohydrocarbyl, dihydrocarbyl or a trihydrocarbyl phosphite, wherein each hydrocarbyl group is saturated. In several embodiments each hydrocarbyl group independently contains from about 8 to about 30, or from about 12 up to about 28, or from about 14 up to about 24, or from about 14 up to about 18 carbons atoms. In one embodiment, the hydrocarbyl groups are alkyl groups. Examples of hydrocarbyl groups include tridecyl, tetradecyl, pentadecyl, hexadecyl, heptadecyl, octadecyl groups and mixtures thereof.

In one embodiment, the friction modifier is a fatty imidazoline comprising fatty substituents containing from 8 to about 30, or from about 12 to about 24 carbon atoms. The substituent may be saturated or unsaturated, preferably saturated. In one aspect, the fatty imidazoline may be prepared by reacting a fatty carboxylic acid with a polyalkylenepolyamine, such as those discussed above. A suitable fatty imidazoline includes those described in U.S. Pat. No. 6,482,777.

The friction modifiers can be used alone or in combination. The friction reducing agents are present in the range of about 0 wt % to 60 wt %, or from about 0.25 wt % to about 40 wt %, or from about 0.5 wt % to about 10 wt % total weight of the gel.

The anti-misting agents include very high (≧100,000 Mn) polyolefins such as 1.5 Mn polyisobutylene (for example the material of the trades name Vistanex®), or polymers containing 2-(N-acrylamido), 2-methyl propane sulfonic acid (also known as AMPS®) or derivatives thereof, and the like.

The anti-misting agents can be used alone or in combination. The anti-misting agents are present in the range of about 0 wt % to 10 wt %, or from about 0.25 wt % to about 10 wt %, or from about 0.5 wt % to about 2.5 wt % total weight of the gel.

The corrosion inhibitors include alkylated succinic acids and anhydrides derivatives thereof, organo phosphonates and the like. The rust inhibitors may be used alone or in combination. The rust inhibitors are present in the range of about 0 wt % to about 20 wt %, and in one embodiment in the range from about 0.0005 wt % to about 10 wt % and in another embodiment in the range from about 0.0025 wt % to about 2.5 wt % total weight of the gel.

The ashless metal deactivators include derivatives of benzotriazoles such as tolyltriazole, N,N-bis(heptyl)-ar-methyl-1H-benzotriazole-1-methanamine, N,N-bis(nonyl)-ar-methyl-1H-Benzotriazole-1-methanamine, N,N-bis(decyl)ar-methyl-1H-Benzotriazole-1-methanamine, N,N-(undecyl) ar-methyl-1H-benzotriazole-1-methanamine, N,N-bis (dodecyl)ar-methyl-1H-Benzotriazole-1-methanamine N,N-bis(2-ethylhexyl)-ar-methyl-1H-Benzotriazole-1-methanamine and mixtures thereof. In one embodiment the metal deactivator is N,N-bis(1-ethylhexyl)ar-methyl-1H-benzotriazole-1-methanamine; 1,2,4-triazoles, benzimidazoles, 2-alkyldithiobenzimidazoles; 2-alkyldithiobenzothiazoles; 2-N,N-dialkyldithio-carbamoyl)benzothiazoles; 2,5-bis(alkyl-dithio)-1,3,4-thiadiazoles such as 2,5-bis(tert-octyldithio)-1,3,4-thiadiazole 2,5-bis(tert-nonyldithio)-1,3,4-thiadiazole, 2,5-bis(tert-decyldithio)-1,3,4-thiadiazole, 2,5-bis(tert-undecyldithio)-1,3,4-thiadiazole, 2,5-bis(tert-dodecyldithio)-1,3,4-thiadiazole, 2,5-bis(tert-tridecyldithio)-1,3,4-thiadiazole, 2,5-bis(tert-tetradecyldithio)-1,3,4-thiadiazole, 2,5-bis(tert-octadecyldithio)-1,3,4-thiadiazole, 2,5-bis(tert-nonadecyldithio)-1,3,4-thiadiazole, 2,5-bis(tert-eicosyldithio)-1,3,4-thiadiazole and mixtures thereof; 2,5-bis(N,N-dialkyldithiocarbamoyl)-1,3,4-thiadiazoles; 2-alkydithio-5-mercapto thiadiazoles; and the like.

The ashless metal deactivators may be used alone or in combination. The ashless metal deactivators are present in the range of about 0 wt % to about 50 wt %, or from about 0.0005 wt % to about 25 wt %, or from about 0.0025 wt % to about 10 wt % total weight of the gel.

The demulsifiers include polyethylene and polypropylene oxide copolymers and the like. The demulsifiers may be used alone or in combination. The demulsifiers are present in the range of about 0 wt % to about 20 wt %, or from about 0.0005 wt % to about 10 wt %, or from about 0.0025 wt % to about 2.5 wt % total weight of the gel.

The lubricity aids include glycerol mono oleate, sorbitan mono oleate and the like. The lubricity additives may be used alone or in combination. The lubricity additives are present in the range of about 0 wt % to about 50 wt %, or from about 0.0005 wt % to about 25 wt %, or from about 0.0025 wt % to about 10 wt % total weight of the gel.

The flow improvers include ethylene vinyl acetate copolymers and the like. The flow improvers may be used alone or in combination. The flow improvers are present in the range of about 0 wt % to about 50 wt %, or from about 0.0005 wt % to about 25 wt %, or from about 0.0025 wt % to about 5 wt % total weight of the gel.

The cloud point depressants include alkylphenols and derivatives thereof, ethylene vinyl acetate copolymers and the like. The cloud point depressants may be used alone or in combination. The cloud point depressants are present in the range of about 0 wt % to about 50 wt %, or from about 0.0005 wt % to about 25 wt %, or from about 0.0025% to about 5 wt % total weight of the gel.

The pour point depressants include alkylphenols and derivatives thereof, ethylene vinyl acetate copolymers and the like. The pour point depressant may be used alone or in combination. The pour point depressant are present in the range of about 0 wt % to about 50 wt %, or from about 0.0005 wt % to about 25 wt %, or from about 0.0025 wt % to about 5 wt % total weight of the gel.

The seal swell agents include organo sulfur compounds such as thiophene, 3-(decyloxy)tetrahydro-1,1-dioxide, phthalates and the like. The seal swell agents may be used alone or in combination. The seal swell agents are present in the range of about 0 wt % to about 50 wt %, or from about 0.0005 wt % to about 25 wt %, or from about 0.0025 wt % to about 5 wt % total weight of the gel.

Optionally, other components can be added to the additive gel which includes base stock oils, inert carriers, dyes, bacteriostatic agents, solid particulate additives, and the like so long as these components do not have a detrimental effect on the gel.

In one embodiment the properties imparted by the desired additives include dispersancy, antioxidance, corrosion inhibition, wear prevention, scuffing prevention, pitting prevention including micro and macro pitting, friction modifying properties including increased and/or decreased friction coefficients, detergency, viscosity control using viscosity modifiers, foam control or mixtures thereof.

In one embodiment the invention provides a method for lubricating a device. Typically in an engine, the control release gel is delivered from within an oil filter, but any means by which the gel can be brought into contact with the lubricant can be used e.g., container/delivery device within the oil pan, or within a fluid by-pass loop.

The additive gel is positioned within the lubricated device, anywhere the control release gel will be in contact with the lubricant including, but not limited to, lubricating oil, motor oil, hydraulic fluid, transmission driveline fluid, metal working fluid, industrial fluid, grease and the like. The control release gel is positioned anywhere that the circulating lubricant contacts the control release gel such as full flow of oil, bypass of the oil in the reservoir or combinations therein. The location of the control release gel in the device includes, but is not limited to, a filter, drain pan, oil bypass loop, canister, housing, reservoir, pockets of a filter, canister in a filter, mesh in a filter, canister in a bypass system, mesh in a bypass system and the like. One or more locations can contain the control release gel. Further, if more than one control release gel is used it can be identical, similar and/or a different control release gel.

In one embodiment, the control release gel is positioned anywhere in the filter of the device. The filter is a desirable location to place the control release gel because the control release gel and/or spent control release gel can easily be removed, and then replaced with a new and/or recycled control release gel.

The control release gel needs to be in contact with the lubricated device, in one embodiment the control release gel is in contact with the lubricant in the range of about 100% to about 1% of the lubricant system, in another embodiment the control release gel is in contact with the lubricant in the range of about 75% to about 25% of the lubricant system and in another embodiment the control release gel is in contact with the lubricant at about 50% of the lubricant system.

The control release gel is added to the device by any known method depending on the desired form of the control release gel, the desired speed of addition, the desired release rate, the desired mode of operation and/or any of the combinations of the above. The control release gel is added to the system by any known method depending on the total amount of gel that is desired to be released over time, the desired form of the control release gel (e.g., stiffness, consistency, homogeneity and the like), the desired overall dissolution of the control release gel, the desired release rates of a specific component, the desired mode of operation and/or any combinations of the above. In one embodiment the control release composition is a control release gel and is added to the lubricating system by means of an injector pump, or a container in the oil filter. In one embodiment the control release gel is added to the lubricating system by means of an addition device such as an auger system.

The release rate of the additive components in the control release gel is determined primarily by the control release gel formulation. The release rate is also dependent on the form of the control release gel and/or the mode of addition. The control release gel is positioned in a location desirable for the specified and desirable dissolution rate of the specified additives. The control release gel's formulation may be composed of one or more components that selectively dissolve completely or a portion of the components remain till the end of its service life or combinations thereof.

In accordance with the present invention, a control release gel can be used in any device that uses a lubricant including internal combustion engines which include mobile and stationary engines, natural gas engines, diesel engines, gasoline engines, marine diesel engines, generators, on highway and/or off highway engines, hydraulic systems, transmission systems, automatic transmissions, gears, gear boxes which include manual transmissions and differentials (e.g., front and rear drive axles and industrial speed increasers or reducers), power equipment, metalworking fluids, metalworking coolant systems, pumps, suspension systems, other lubricated mechanical systems, industrial lubricated system and the like.

SPECIFIC EMBODIMENTS

1. Gel 1 EP/AW Gel

An extreme pressure/anti-wear gel (EP/AW Gel) is formed with the composition shown in Table 1.

TABLE 1

Gel 1 (EP/AW Gel)

| Component | % wt |
|---|---|
| OSP PIBSA dispersant[a] | 9% |
| Overbased detergent[b] | 44% |
| EPDM[c] (viscosity modifier) | 0.5% |
| ZDP[d] | 25% |
| PIBSA[e] | 15% |
| Mineral Oil (low viscosity component) | 6.5% |

[a]One-step ($Cl_2$-assisted) polyisobutenyl succinimide, derived from 2000 Mn polyisobutylenene, maleic anhydride and ethylene diamine polyamine, TBN = 15.
[b]Overbased $Ca(OH)_2$/alkybenzenesulfonate detergent, TBN = 400.
[c]Ethylene-propylene diene monomer copolymer, MW = $10^5$-$10^6$
[d]Zinc O,O-di(2-ethylhexyl) dithiophosphate
[e]One-step ($Cl_2$-assisted) polyisobutenyl succinicanhydride, derived from 2000 Mn polyisobutylene and maleic anhydride The EPDM, mineral oil and the detergent are mixed with a high speed/high shear mixer at about 120° C. to form component A. The dispersant, ZDP and PIBSA are mixed to form component B. Component A was then added to component B with stirring and the resulting mixture heated at 100° C. for about 12 hours. The resulting Gel 1 (EP/AW Gel) was used in Example 3 and is suitable for hydraulic lubricant applications.

2. Comparative to Example 1.

The Gel 1 (EP/AW Gel) without the PIBSA and EPDM and prepared in the same way as Gel 1 described in Example 1 and did not form a gel.

3. EP/AW Gel Vehicle Release Test. About 78 g of Gel 1 (EP/AW Gel) was loaded into a cylindrical cup, with about 2 mm holes located on the top face. The container was placed at the crown end of an oil filter of the same size and fittings as a Fram PH3387A oil filter, as described in U.S. Pat. No. 6,843,916, and installed on a 1997 GMC Jimmy. The vehicle was then driven tinder normal stop-and-go conditions for about 500 miles, with oil samples taken at regular intervals and the zinc (Zn) and phosphorous (P) content of the oil analyzed by Inductively Coupled Plasma Elemental Analysis. The results are shown in Table 2 and demonstrate that slow release of ZDP is obtained using Gel 1 (EP/AW Gel).

TABLE 2

(100% Zn release = 0.0421% added; 100% P release = 9.9377% added)

| | Miles | | |
|---|---|---|---|
| | 0 | 100 | 500 |
| % Zn | 0.0837 | 0.0849 | 0.0968 |
| Δ % Zn | 0 | 0.0012 | 0.0131 |
| % Zn release | 0% | 3% | 31% |
| % P | 0.0727 | 0.0756 | 0.086 |
| Δ % P | 0 | 0.0029 | 0.0133 |
| % P release | 0% | 8% | 35% |

4. Controlled Release Dispersant/Detergent-Antioxidant Gel

A slow-release dispersant-antioxidant-friction modifier gel (DIS/AO/FM Gel) is formed of the composition shown in Table 3.

TABLE 3

Gel 2 (DIS/AO/FM Gel)

| Component | % wt |
|---|---|
| OSP PIBSA dispersant[a] | 21.7% |
| Overbased detergent[b] | 43.4% |
| PIBSA[e] (viscosity modifier) | 10.9% |
| Molybdenum dithiocarbamate (Modtc)[f] | 2.2% |
| Nonyl DPA antioxidant[g] | 10.9% |
| 2,6-dit-butylphenolic antioxidant[h] | 10.9% |

[f]Akeda Saukuralube 100 friction modifier (FM)
[g]Derived from alykylation of diphenylamine with nonene using AlCl3 catalyst, Total Base Number = 156 meq KOH/g
[h]2,6di-tert-butyl, 4-(3-butylpropanoyl)phenol All the components except the detergent are mixed. To this mixture is added the detergent with stirring and the resulting mixture heated at 100° C. for about 12 hours. The resulting Gel 2 (DIS/AO/FM Gel) was used in Example 6 and is suitable for engine oil applications.

5. Comparative to Example 4. Gel 2 (DIS/AO/FM Gel) without the PIBSA is made by the same method described in Example 4, and did not form a gel. (is PIBSA activity as what here?)

6. Controlled Release Gel 2 (DIS/AO/FM Gel) Release—Vehicle Test

The Gel 2 (LDIS/AO/FM) about 78 g, was loaded into a cylindrical cup, with about 2 mm holes located on the top face. The container was placed at the crown end of an oil filter of the same size and fittings as a Fram PH3387A oil filter, as described in U.S. Pat. No. 6,843,916, and installed on a 1990 Pontiac transport. The vehicle was then driven under normal stop-and-go conditions for about 500 miles, with oil samples taken at regular intervals and the calcium (Ca) and molybdenum (Mo) content of the oil analyzed by Inductively Coupled Plasma Elemental Analysis. The results are shown in Table 4 and demonstrate that slow release of the Gel 2 (DIS/AO/FM Gel).

TABLE 4

Gel 2. (100% Mo release = 0.0072% added; 100% Ca release = 0.2232% added)

| | Miles | | | | |
|---|---|---|---|---|---|
| | 0 | 569 | 1429 | 1532 | 2345 |
| % Ca | 0.2047 | 0.2111 | 0.2258 | 0.2220 | 0.2281 |
| Δ % Ca | 0.0000 | 0.0064 | 0.0212 | 0.0173 | 0.0235 |
| % Ca release | 0% | 6% | 8% | 8% | 11% |
| % Mo | 0.0001 | 0.0011 | 0.0018 | 0.0021 | 0.0025 |
| Δ % Mo | 0.0000 | 0.0010 | 0.0017 | 0.0020 | 0.0024 |
| % Mo release | 0% | 14% | 24% | 28% | 34% |

7. Controlled Release Friction Modifier Gel 3—Automatic Transmission Applications A slow-release friction modifier Gel 3 (FM Gel 3) is formed of the composition shown in Table 5.

TABLE 5

| Gel 3 | |
|---|---|
| Component | % wt |
| EPDM[c] (viscosity modifier) | 0.7% |
| Overbased detergent[b] | 56% |
| PIBSA[e] (viscosity modifier) | 25% |
| Ethomeen T/12[i] (friction modifier) | 10% |
| Mineral Oil (low viscosity component) | 8.3% |

[i]N-Tallowalkyl-2,2'-iminobisethanol

The EPDM, mineral oil and the detergent are mixed with a high speed/high shear mixer at about 120° C. to form component A. The PIBSA and the ethomeen are mixed at about 55° C. to form component B. Component A is mixed with component B at about 80° C. and the resulting mixture heated at about 1000 C for about 12 hours. The resulting Gel 3 (FM Gel 3) was used in Example 9 and is suitable for automatic transmission fluid applications.

8. Comparative to Example 7. The same composition of Gel 3 (FM Gel) without the PIBSA was made by the same method described in Example 7 and did not form a gel.

9. Controlled Release Gel 3 (FM Gel 1) Release—Automatic Transmission Test

A device which measures maximum oscillation (torque) amplitude as a function of clutch pressure for an automatic transmission (ZF 6HP26E E-clutch) was filled with about 14 L of an aged automatic transmission fluid ("ATF") fluid which exhibited a loud squeaking noise when in service. About 42 g of Gel 3 (FM Gel) was loaded into about 21× about 2 g plastic caps (½, inch×½ inch cylinders) and was added to the filter of the device running at about 110° C. and about 20 L/min fluid flow. The torque amplitude (in Nm) as a function of clutch pressure at about 30 mm intervals is shown in Table 6 below.

TABLE 6

| Clutch pressure ($N/mm^2$) | Aged fluid after run-in | Aged fluid + FM Gel 1, after 30 min | Aged fluid + FM Gel 1, after 60 min | Aged fluid + FM Gel 1, after 90 min |
|---|---|---|---|---|
| 0.375 | 31.11 | 0.72 | 0.83 | 1.11 |
| 0.500 | 58.23 | 1.08 | 1.10 | 1.72 |
| 0.625 | 100.32 | 1.08 | 1.50 | 2.19 |
| 0.750 | 124.83 | 1.30 | 1.72 | 1.91 |
| 0.875 | 152.54 | 1.34 | 1.45 | 2.45 |
| 1.000 | 167.76 | 2.25 | 1.57 | 2.64 |
| 1.125 | 178.40 | 5.25 | 1.73 | 2.68 |
| 1.250 | 183.92 | 30.96 | 4.05 | 2.52 |
| 1.375 | 185.10 | 50.63 | 5.30 | 3.33 |
| 1.500 | 173.17 | 90.32 | 56.37 | 5.96 |
| 1.625 | 179.70 | 94.32 | 68.34 | 34.52 |
| 1.750 | 187.17 | 96.90 | 68.46 | 26.25 |
| 1.875 | 198.53 | 105.62 | 82.81 | 14.13 |
| 2.000 | 187.84 | 110.99 | 99.97 | 28.96 |

Reduction of torque amplitude to less than about 50 Nm at clutch pressures above about 1.6 $N/mm^2$ which is indicative of elimination of the noise exhibited by the aged fluid and demonstrates the effective use of the Gel 3 (FM Gel) in this application.

10, Viscosity Modifier—Gel 4 (VM Gel). A viscosity modifier-releasing gel, Gel 4 (VM Gel) was prepared with the composition shown in Table 7.

TABLE 7

| Example 7 | |
|---|---|
| Component | % wt |
| OSP PIBSA dispersant[a] | 2.4% |
| Overbased Detergent[b] | 9.6% |
| EPDM[c] (viscosity modifier) | 13.2% |
| Mineral Oil (low viscosity component) | 74.8% |

The EPDM and the mineral oil are mixed and half of the resulting solution is mixed with the dispersant to form component A. The other half of the EPDM/mineral oil solution is mixed with the detergent to form component B. Component A and B are then mixed and the resulting mixture is heated at about 100° C. for about 12 hours. The resulting Gel 4 (VM Gel) was used in Example 10 and is suitable for use in engine oil applications to compensate for viscosity is lost over time, for example as a result of fuel dilution of the engine oil in diesel engines.

11. Example. Controlled Release VM Gel 5 Release—Lab Test

About 6 g of Gel 4 (VM Gel) was loaded into a metal about 2-oz jar cap and placed in the bottom of about a 100-mL beaker and about 60 g of Valvoline 10W-30 oil was added. The resulting mixture was heated and oil samples were taken at regular intervals over 2 days and the kinematic viscosity measured at about 100° C. by ASTM Test Method D445_100. The results are shown in Table 8. These results show that controlled release of viscosity modifier can be achieved using the Gel 4 (VM gel).

TABLE 8

| Example 8. (100% release = 4.6 cSt @ 100 C. added) | | | |
|---|---|---|---|
| | Test Hours | | |
| | 0 | 24 | 48 |
| % VM Release | 0% | 21% | 34% |
| Kin Vis@100 C., cSt | 10.2 | 11.2 | 11.8 |
| Δ Kin Vis@100 C., cSt | 0 | 1.0 | 1.6 |

12. Controlled Release Friction Modifier Gel 5 (FM Gel 5)—Engine Oil Applications Gel 5 (FM Gel 5) is formed of the composition in Table 9, suitable for use in engine oil applications for fuel economy improvement.

TABLE 9

| Gel 5 | |
|---|---|
| Component | % wt |
| GMO[j] | 10.0% |
| Overbased Detergent[b] | 58.0% |
| OSP PIBSA dispersant[a] | 10.0% |
| Molybdenum dithiocarbamate (Modtc)[f] | 4.1% |
| PIBSA[e] (viscosity modifier) | 17.9% |

[j]Glycerol Monooleate friction modifier - gel breaking surfactant

13. Controlled Release Gel 5 (FM Gel 5) Release—Vehicle test

About 47 g of Gel 5 (FM Gel 5) was loaded into a cylindrical cup, with about 2 mm holes located on the top face. The container was placed at the crown end of an oil filter of the same size and fittings as a Fram PH4967 oil filter, as described in U.S. Pat. No. 6,843,916, and installed on a 2.21 L 4-cylinder 1997 Toyota Camry. The vehicle was then driven under normal stop-and-go conditions for about 4451 miles, with oil samples taken at regular intervals. The molybdenum (Mo) content of the oil analyzed by Inductively Coupled Plasma Elemental Analysis and the coefficient of friction measured. The results are shown in Table 10 and demonstrate slow release of the Mo-containing friction modifier from the Gel 5 (FM Gel) with concurrent drop in friction coefficient of the fluid.

TABLE 10

Example 10. (100% Mo FM release = 0.0054% Mo in oil)

| | Miles | | | | | |
|---|---|---|---|---|---|---|
| | 1 | 151 | 246 | 400 | 700 | 924 |
| % Gel release | 0% | 12% | 12% | 22% | 37% | 51% |
| % Mo | 0.0043% | 0.0049% | 0.0049% | 0.0055% | 0.0063% | 0.0070% |
| Δ % Mo | 0% | 0.0006% | 0.0006% | 0.0012% | 0.0020% | 0.0027% |
| Friction Coef | 0.14 | | 0.127 | 0.12 | 0.122 | 0.129 |
| | Miles | | | | | |
| | 1233 | 1692 | 2187 | 2782 | 3354 | 4451 |
| % Gel release | 60% | 67% | 75% | 77% | 80% | 89% |
| % Mo | 0.0075% | 0.0079% | 0.0083% | 0.0085% | 0.0086% | 0.0091% |
| Δ % Mo | 0.0032% | 0.0036% | 0.0040% | 0.0042% | 0.0043% | 0.0048% |
| Friction Coef | 0.129 | 0.129 | 0.129 | 0.134 | 0.131 | 0.14 |

The lubricant additive gel may be used in a variety of applications including gasoline engines, diesel engines, lubricating systems, and a wide variety of machinery. The lubricant additive gel can be used in any device, system, or process where maintenance of the quality of the lubricant has value. More specifically, those applications demonstrated in the above examples include:

1. Controlled-release EP/Anti-wear agent gels for hydraulic applications,
2. Controlled release dispersant/detergent-antioxidants gels for extended service life engine oils,
3. Controlled release ethoxylated amine friction modifier gels for low noise automatic transmission operation,
4. Controlled release viscosity modifier gels for recovery of lost viscosity (e.g. due to fuel dilution) in engine oils (e.g. passenger car diesel engines), and
5. Controlled release coefficient of friction lowering friction modifier gels for enhanced fuel economy engine oils.

We claim:

1. A control release composition comprising: an additive gel wherein the gel consists of:

1) an overbased detergent having a total base number (TBN)≧13 or mixtures thereof; wherein the gel is free of ashless dispersants;
2) an acid component selected from the group consisting of acid formed from a polymer containing acidic groups in the backbone, a polyacidic compound, maleic anhydride styrene copolymers, or mixtures thereof;
3) a viscosity modifier; and
4) optionally one or more other lubricant additives selected from the group consisting of the viscosity modifier(s), friction modifier(s), ashless detergent(s), cloud point depressant(s), pour point depressant(s), demulsifier(s), flow improver(s), anti-static agent(s), ashless antioxidant(s), antifoam(s), corrosion/rust inhibitor(s), extreme pressure/antiwear agent(s), seal swell agent(s), lubricity aid(s), antimisting agent(s), a low viscosity material, a gel-breaking surfactant or mixtures thereof.

2. The composition of claim 1 wherein the weight ratio of the overbased detergent to the acid component is about 0.01 to about 100; and wherein the weight ratio of the viscosity modifier to the total gel is about 0.001 to about 0.99; and wherein the weight ratio of the optional lubricant additives to the total gel is about 0.001 to about 0.99.

3. The composition of claim 1 wherein the overbased detergent is selected from the group consisting of overbased sulfonates, phenates, salicylates, carboxylates, overbased calcium sulfonate detergents, overbased detergents containing metals selected from the group consisting of Mg, Ba, Sr, Na, Ca and K or mixtures thereof.

4. The composition of claim 1 wherein the acid component is selected from the group consisting of polymers derived from styrene and maleic anhydride, polymers derived from acrylates, acrylic acid, acrylic acid esters, methacrylic acid and its esters, maleic anhydride styrene copolymers, polymers derived from high molecular weight esters and acids, polymers derived esterified maleic anhydride styrene copolymers;

polymers derived from esterified ethylene diene monomer copolymer, surfactants with acidic groups in the backbone; emulsifiers with acidic groups in the backbone; polyacidic compounds, polyacidic surfactants, polyacidic dispersants, functionalized derivatives of such component herein or mixtures thereof.

5. The composition of claim 1 wherein the overbased detergent is present in the range of about 0.01 wt % to about 99 wt %, and wherein the acid is present in the range from about 0.01 wt % to about 99 wt %, and wherein the viscosity modifier is present in the range from about 0.1 wt % to about 99 wt %, and wherein the optional lubricant additives are present in the range from 0 wt % to about 50 wt % of the control release gel.

6. The composition of claim 1 wherein the viscosity modifier is selected from the group consisting of polyolefins, polyethylenes, polypropylenes, polyalphaolefins, ethylene-propylene copolymers, maleneated derivatives of the materials herein, polyisobutylenes, maleic anhydride and their diene derivatives, polymethacrylates, maleic anhydride-styrene copolymers and esters and their diene derivatives, or mixtures thereof.

7. The composition of claim 1 wherein the viscosity modifier is selected from the group consisting of hydrogenated copolymers of styrene-butadiene, ethylene-propylene copolymers, polyisobutenes, hydrogenated styrene-isoprene polymers, hydrogenated isoprene polymers, polymethacrylates, polyacrylates, polyalkyl styrenes, alkenyl aryl conjugated diene copolymers, polyolefins, esters of maleic anhydride-styrene copolymers, functionalized polyolefins, ethylene-propylene copolymers functionalized with the reaction product of maleic anhydride and an amine, polymethacrylate functionalized with an amine, styrene-maleic anhydride copolymers reacted with an amine, polymethacrylate polymers, esterified polymers, esterified polymers of a vinyl aromatic monomer and an unsaturated carboxylic acid or derivative thereof, olefin copolymers, ethylene-propylene copolymer, polyisobutylene or mixtures thereof.

8. The composition of claim 1 wherein the other lubricant additive is selected from the group consisting of a low viscosity material, a gel-breaking surfactant or mixtures thereof.

9. The composition of claim 8 wherein the gel breaking surfactants are selected from the group consisting of glycerol monooleate, tall oil fatty acid, linoleic and stearic acids and derivatives thereof, non-ionic surfactants, and mixtures thereof.

10. The composition of claim 8 wherein low viscosity materials are selected from the group consisting of minerals oils, synthetic oils, low viscosity lubricant additives or mixtures thereof.

11. A process comprising:

1) contacting a control release composition, comprising a gel, with a lubricant in a device, wherein the gel consists of;

a) an overbased detergent, having a total base number (TBN)≧13 or mixtures thereof;

b) an acid component selected from the group consisting of acid formed from a polymer containing acidic groups in the backbone, a polyacidic compound, maleic anhydride styrene copolymers, or mixtures thereof;

c) a viscosity modifier; and d) optionally one or more other lubricant additives selected from the group consisting of the viscosity modifier(s), friction modifier(s), ashless detergent(s), cloud point depressant(s), pour point depressant(s), demulsifier(s), flow improver(s), anti-static agent(s), ashless antioxidant(s), antifoam(s), corrosion/rust inhibitor(s), extreme pressure/antiwear agent(s), seal swell agent(s), lubricity aid(s), antimisting agent(s), a low viscosity material, a gel-breaking surfactant or mixtures thereof wherein the gel is free of ashless dispersants;

2) dissolving the control release gel over time.

12. The process of claim 11 further comprising releasing the desired additives from the control release gel into the lubricant of the device.

13. The process of claim 11 wherein the viscosity modifier is selected from the group consisting of hydrogenated copolymers of styrene-butadiene, ethylene-propylene copolymers, polyisobutenes, hydrogenated styrene-isoprene polymers, hydrogenated isoprene polymers, polymethacrylates, polyacrylates, polyalkyl styrenes, alkenyl aryl conjugated diene copolymers, polyolefins, esters of maleic anhydride-styrene copolymers, functionalized polyolefins, ethylene-propylene copolymers functionalized with the reaction product of maleic anhydride and an amine, polymethacrylate functionalized with an amine, styrene-maleic anhydride copolymers reacted with an amine, polymethacrylate polymers, esterified polymers, esterified polymers of a vinyl aromatic monomer and an unsaturated carboxylic acid or derivative thereof, olefin copolymers, ethylene-propylene copolymer, polyisobutylenes or mixtures thereof.

14. The process of claim 11 wherein the device is selected from the group consisting of internal combustion engines, natural gas engines, stationary engines, diesel engines, marine diesel engines, generators, power equipment, hydraulic systems, lubricated mechanical systems, transmission systems, automatic transmissions, manual transmissions, gears, differentials, gear boxes, axles, metal working coolant systems, metal working fluid systems, industrial lubricated systems lubricated mechanical systems, pumps, suspension systems, or combinations thereof.

* * * * *